US007034463B2

(12) United States Patent
Nobe

(10) Patent No.: US 7,034,463 B2
(45) Date of Patent: Apr. 25, 2006

(54) TRAVELING-WAVE TUBE HAVING HEAT RADIATING STRUCTURE WITH HIGH THERMAL CONDUCTIVITY

(75) Inventor: Takeshi Nobe, Kanagawa (JP)

(73) Assignee: NEC Microwave Tube, Ltd., Kanagawa (JP)

( * ) Notice: Subject to any disclaimer, the term of this patent is extended or adjusted under 35 U.S.C. 154(b) by 21 days.

(21) Appl. No.: 10/937,557

(22) Filed: Sep. 10, 2004

(65) Prior Publication Data

US 2005/0057157 A1 Mar. 17, 2005

(30) Foreign Application Priority Data

Sep. 16, 2003 (JP) ..... 2003-323392

(51) Int. Cl.
*H01J 25/34* (2006.01)

(52) U.S. Cl. ..... 315/3.5; 315/5.38

(58) Field of Classification Search ..... 315/3.5, 315/3.6, 5.14, 5.15, 5.17, 5.22, 5.23, 5.35, 315/5.38, 46–50, 39.3, 39.63; 313/21, 40, 313/44, 45

See application file for complete search history.

(56) References Cited

U.S. PATENT DOCUMENTS 5,952,785 A * 9/1999 Komm et al. ..... 315/3.5
5,990,600 A * 11/1999 Konishi et al. ..... 313/45
6,847,168 B1 * 1/2005 Ives et al. ..... 315/5.14

FOREIGN PATENT DOCUMENTS

JP 07-045207 2/1995

* cited by examiner

*Primary Examiner*—Wilson Lee
(74) *Attorney, Agent, or Firm*—Dickstein, Shapiro, Morin & Oshinsky, LLP.

(57) ABSTRACT

A traveling-wave tube is provided which has a heat radiating structure with good heat conductivity from the collector core to the heat sink. An insulator is disposed around and in contact with the outer peripheral surface of a collector electrode and has a slit in parallel with a tube axis. A radiator is disposed outside of and in contact with the insulator and has a slot formed on the top surface thereof extending in parallel with the tube axis. The radiator also has one or more grooves that insect the slot and receive therein a fastening member having a length shorter than the length of the groove and formed with screwed holes extending through both end portions thereof in the axial direction. By adjusting amounts by which bolts are screwed into the fastening member through the throughholes formed through the radiator, the gaps in the groove between the radiator and both end surfaces of the fastening member can be varied. This allows a fastening force to be transmitted from the radiator to the entire insulator, thereby readily adjusting the degree of contact between the radiator and insulator and collector electrode.

6 Claims, 5 Drawing Sheets

TRAVELING-WAVE TUBE HAVING HEAT RADIATING STRUCTURE WITH HIGH THERMAL CONDUCTIVITY

BACKGROUND OF THE INVENTION

1. Field of the Invention

The present invention relates to a traveling-wave tube, and more particularly, to a traveling-wave tube having a conduction cooling type heat radiating structure in its collector unit.

2. Description of the Related Art

A traveling-wave tube has such main components as an electron gun unit for generating an electronic beam; a high-frequency circuit for amplifying high-frequency power through the interaction of the electron beam generated by the electron gun with a high-frequency electric field; and a collector unit for collecting the electron beam which has finished the interaction in the high-frequency circuit. The collector unit generates an enormous amount of heat when it converts kinetic energy that is possessed by the electron beam into thermal energy with the potential on a collector electrode itself. For this reason, the collector must be cooled down by some kind of heat radiating structure.

Conventionally, there are a variety of heat radiating structures. One such heat radiating structure is the conduction cooling type which conducts heat generated in a collector unit to a radiator that is disposed in close contact with the outer peripheral wall of the collector through an insulating material, such as ceramic, under the action of thermal conduction, and dissipates the heat to a heat sink or a substrate external to a traveling-wave tube.

FIGS. 1, 2 are cross-sectional views each illustrating the structure of a conduction cooling type heat dissipator in a collector unit for a conventional traveling-wave tube disclosed in JP-7-45207-A. A heat dissipator illustrated in FIG. 1 comprises cylindrical ceramic 103 disposed outside of and in contact with collector core 101; radiator 102 disposed outside of and in contact with cylindrical ceramic 103; and heat sink 104 on which radiator 102 is directly mounted. A heat dissipator illustrated in FIG. 2, in turn, comprises cylindrical ceramic 103 disposed outside of and in contact with collector core 101; radiator 102 disposed outside of and in contact with cylindrical ceramic 103; and heat sink 104 on which radiator 102 is directly mounted. Cylindrical ceramic 103 is formed with slit 106 extending in an axial direction. The top of radiator 102, opposite to heat sink 104, is formed with a slot extending in the axial direction and two protrusions, such that the protrusions of radiator 102 are fastened with a screw.

In the structure of the conventional traveling-wave tube illustrated in FIG. 1, entire collector core 101 and cylindrical ceramic 103 are covered with radiator 102 without fastening feature, so that each component must be made with a high dimensional accuracy and therefore exhibits low productivity. On the other hand, in the structure which fastens cylindrical ceramic 103 by radiator 102 itself on the opposite side from heat sink 104, the heat dissipator requires screw fastening feature which protrudes on the top of radiator 102. Due to this fastening feature, a waveguide or the like cannot be directly installed on the top of radiator 102. In addition, this fastening feature applies a force only to the protrusions, and therefore experiences difficulties in fastening the entire insulator, thus causing a lower thermal conductivity.

SUMMARY OF THE INVENTION

It is therefore an object of the present invention to provide a traveling-wave tube which has a heat radiating structure that can readily fasten an entire insulator and consequently exhibits a high thermal conductivity from the collector core to the heat sink.

It is another object of the present invention to provide a traveling-wave tube which has a heat radiating structure that can find space for the installation of a waveguide or the like above a radiator.

Similar to the prior art example shown in FIG. 2, the insulator has a slit extending in parallel with the axis of the tube, and the radiator has a slot extending in parallel with the axis of the tube, a portion of the insulator including the slit being exposed to the slot. The radiator also has one ore more grooves formed thereon that intersect the slot and receive therein a fastening member having a length shorter than the length the groove. The groove has formed therein screwed holes extending through both end portions in the axial direction. The fastening member is retained within the groove by screwing bolts into the screwed holes through throughholes formed in the radiator.

By adjusting amounts by which bolts are screwed into the fastening member, the gaps in the grooves between the radiator and both end surfaces of the fastening member can be varied. This allows a fastening force to be transmitted from the radiator to the entire insulator, thereby readily adjusting the degree of contact between the radiator and insulator and collector electrode. In addition, since the groove is formed at a position which does not contribute to heat conduction from the radiator to the heat sink to expose the insulator and slit thereof in the groove, the heat radiation efficiency is further improved for heat generated by the collector electrode to the heat sink.

According to one embodiment of the present invention, the radiator has a generally rectangular shape in a cross section perpendicular to the tube axis, and the fastening member has its height and mounting position in the groove set in such a manner that the fastening member does not protrude from a top surface of the radiator.

Consequently, space for installing a waveguide or the like can be ensured above the radiator without increasing the volume of the collector, resulting in the reduction in size of the traveling-wave tube.

According to another embodiment of the present invention, the fastening member is made of a material different from that of the radiator. Preferably, in this case, the material of the fastening member has a mechanical strength higher than that of the radiator.

The above and other objects, features, and advantages of the present invention will become apparent from the following description with reference to the accompanying drawings which illustrate examples of the present invention.

BRIEF DESCRIPTION OF THE DRAWINGS

FIG. 4A is a top plan view taken from the top surface of the collector; FIG. 4B is a partially broken lateral view illustrating the structure thereof along the axis of the traveling-wave tube; FIG. 4C is a cross-sectional view taken along line B–B' in FIG. 4A; and FIGS. 4D and 4E are diagrams like FIGS. 4A and 4C, respectively, from which fastening members and bolts are excluded for facilitating the understanding of the structure of the radiator.

DETAILED DESCRIPTION OF THE PREFERRED EMBODIMENTS

Figure 3:
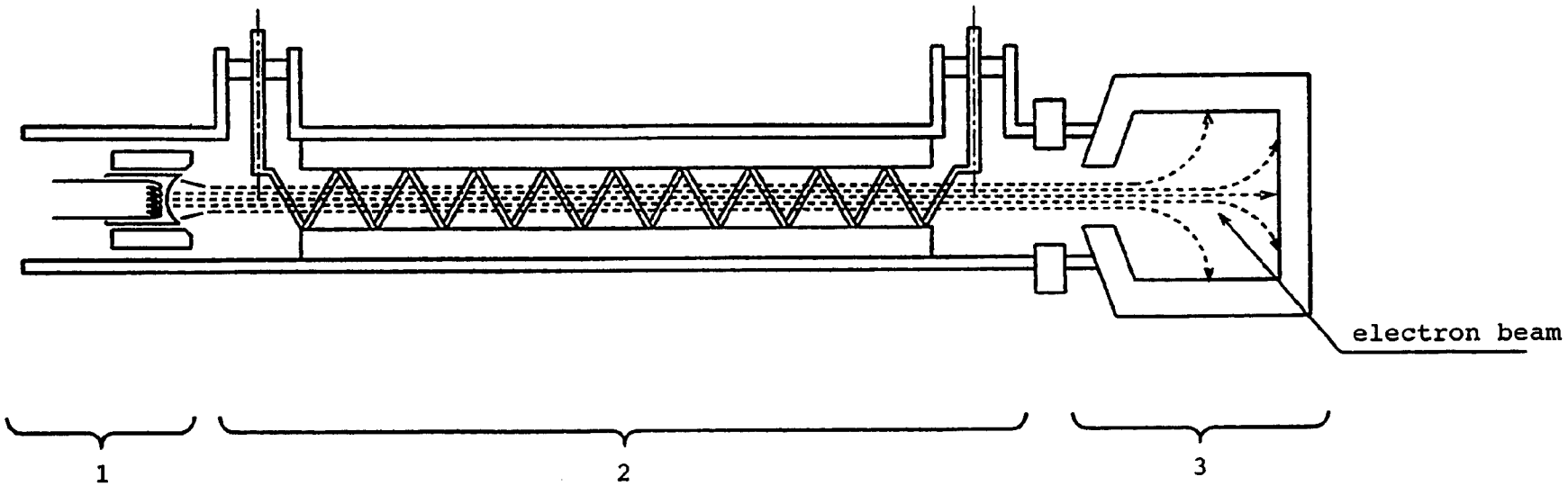
FIG. 3 is a schematic view of a traveling-wave tube according to one embodiment of the present invention.

Referring now to FIG. 3, a traveling-wave tube according to one embodiment of the present invention comprises an electron gun unit 1 for generating an electron beam; a high-frequency circuit 2 for amplifying high-frequency power through the interaction of the electron beam with a high-frequency electric field; and a collector unit 3 for collecting the electron beam. Collector unit 3 includes collector electrode 6 for collecting the electron beam; insulator 7 disposed in contact with the outer peripheral surface of collector electrode 6; radiator 4 disposed outside of and in contact with insulator 7; and fastening members 10, 11 and bolts 12, 13, 14, 15 for bringing radiator 4 into close contact with insulator 7.

Figure 1:
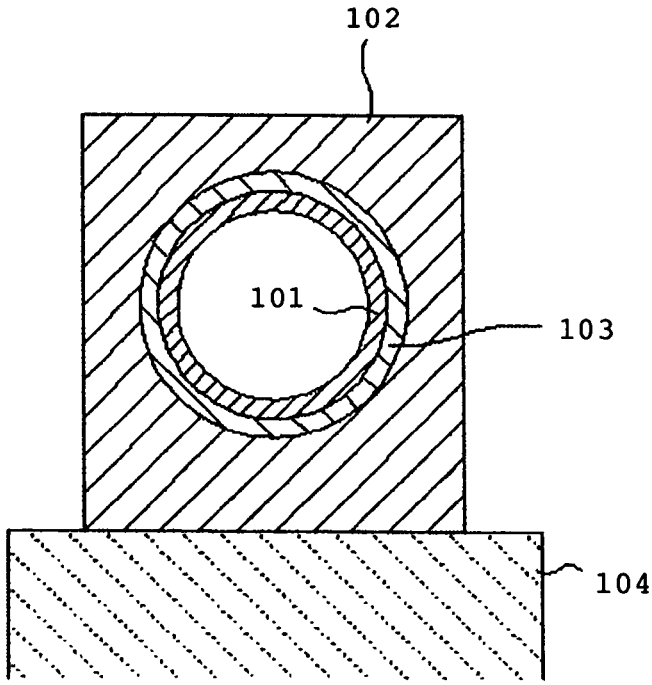
Fig. 1 (Prior Art)
FIGS. 1 and 2 are cross-sectional views each illustrating the structure of a collector heat dissipator for a traveling-wave tube disclosed in JP-7-45207-A.
Figure 2:
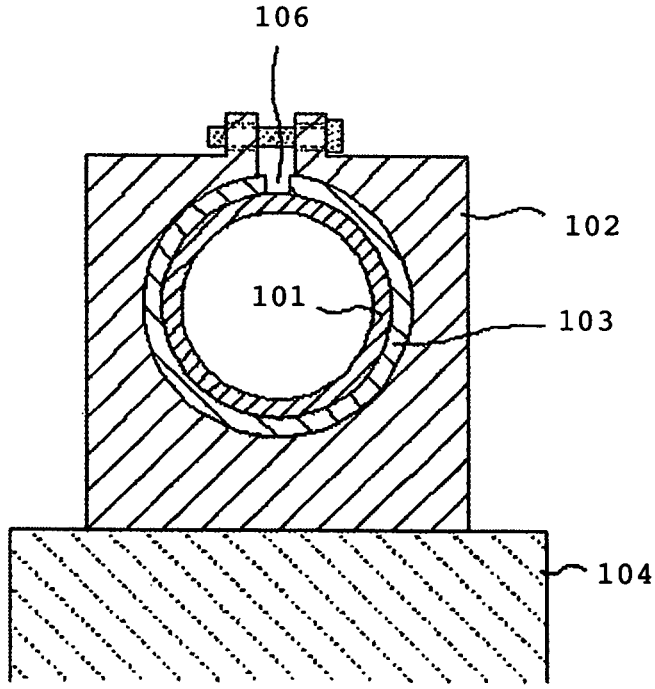
Fig. 2 (Prior Art)

Radiator 4 is made of one piece with a material, such as copper, which excels in thermal conductivity, and has a contact surface in contact with heat sink 5 which is a mounting member. Similar to FIG. 2 of the prior art, radiator 4 has a slot 8 formed on the top surface thereof extending in parallel with tube axis 70 throughout the length of the radiator. In addition, radiator 4 has two grooves 9 formed on the top surface thereof, each intersecting slot 8 at right angles. Furthermore, at predetermined positions on side surfaces 21, 22, of radiator 4 substantially perpendicular to the top surface, parallel with tube axis 70, and opposite to each other, throughholes of a predetermined size are formed to extend through radiator 4 on the same straight line which is parallel with the top surface and perpendicular to tube axis 70. Specifically, throughholes 31, 32 centered at virtual first straight line 71 and having a predetermined diameter are formed on side surface 21 and 22, respectively. Also, side surface 21 is formed with recess 41 which has a diameter larger than that of throughhole 31 and is continuous to throughhole 31, while side surface 22 is formed with recess 42 which has a diameter larger than that of throughhole 32 and is continuous to throughhole 32. Similarly, throughholes 33, 34, centered at virtual second straight line 72 and having a predetermined diameter, are formed on side surfaces 21 and 22, respectively. Side surface 21 is formed with recess 43 which has a larger diameter than that of throughhole 33 and is continuous to throughhole 33, while side surface 22 is formed with recess 44 which has a diameter larger than that of throughhole 34 and is continuous to throughhole 34. All of throughholes 31–34 have the same diameter, as do all recesses 41–44. The depth of recesses 41–44 is set such that each head end 12*h*–15*h* of bolts 12–15 inserted through throughholes 31–34, do not protrude from side surface 21 or 22, and that a certain mechanical strength can be maintained for throughhole 31–34.

Further, the cross-section of radiator 4 perpendicular to tube axis 70 has a generally rectangular shape.

Figure 4A:
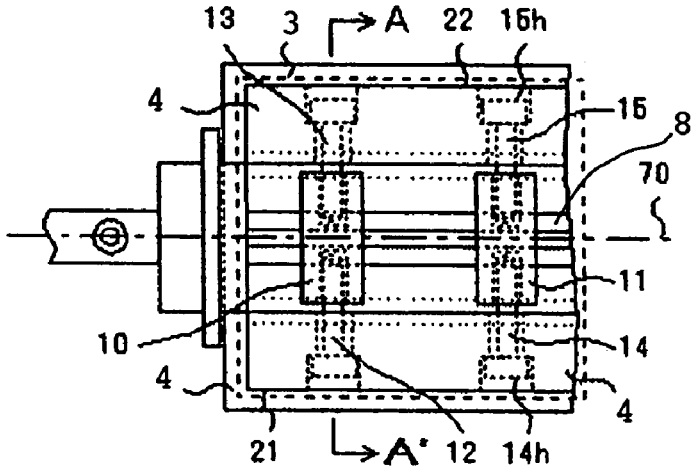
FIGS. 4A–4E are views illustrating a collector including a radiator of the traveling-wave tube shown in FIG. 3, where
Figure 4B:
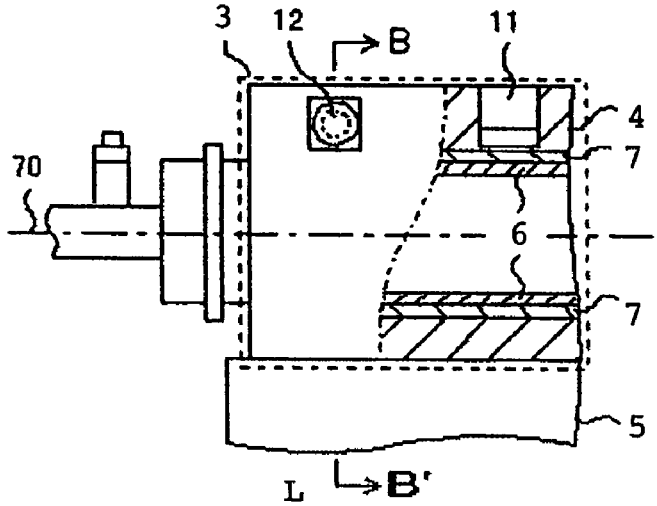
Figure 4C:
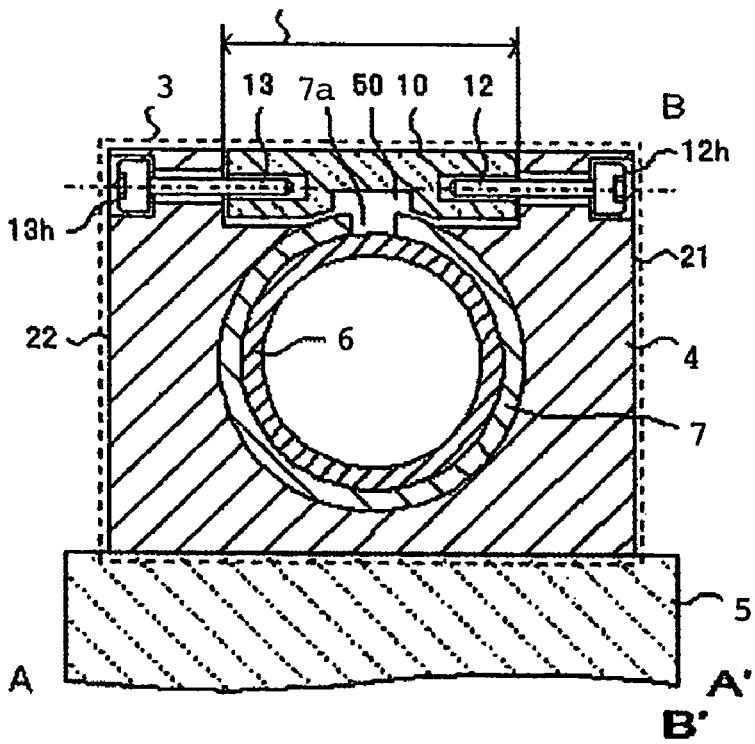
Figure 4D:
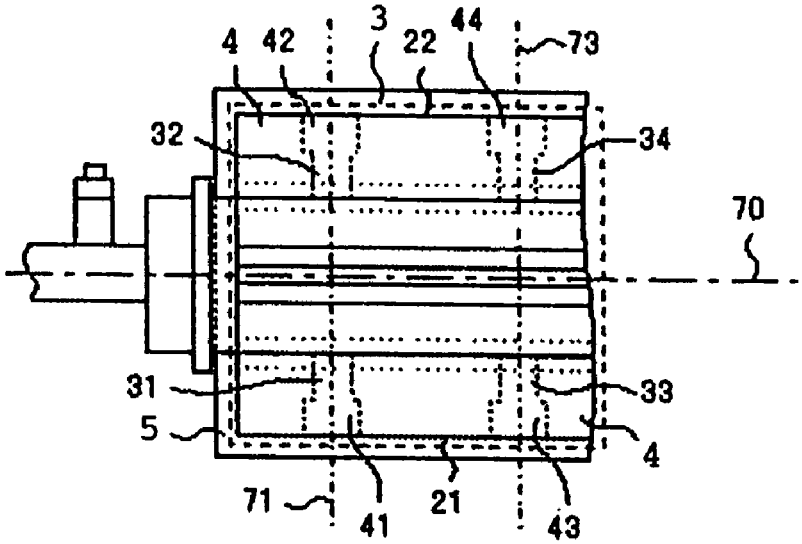
Figure 4E:
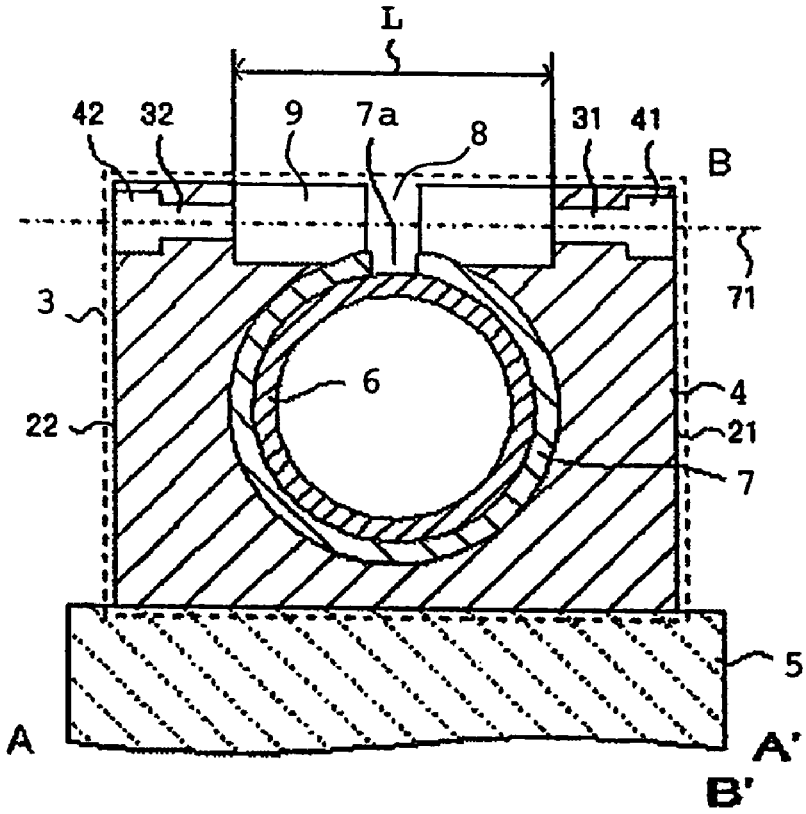

Insulator 7 is made of ceramic such as alumina, aluminum nitride, silicon carbide, or the like. Insulator 7 is formed with slit 7*a* generally in parallel with tube axis 70. As shown in FIG. 4E, insulator 7 is disposed such that slit 7*a* is positioned on the top surface of radiator 4, and is exposed to slot 8.

While fastening members 10, 11 may be made of the same material as radiator 4, fastening members 10, 11 are preferably made of a material having a mechanical strength higher than thereof radiator 4 (for example, stainless steel (SUS304 or the like) if radiator 4 is made of aluminum or copper). The use of a high-strength material allows fastening members 10, 11 to be further reduced in size. While there is no particular limitation on the size of fastening members 10, 11, they must have a length perpendicular to tube axis 70 which is at least smaller than the length L of groove 9 (see FIG. 4E). Also, recesses 50 is formed on each of the surfaces of fastening members 10, 11, facing tube axis 70 when they are mounted in grooves 9, while fastening members 10, 11 have flat surfaces opposite to those formed with recesses 50. Recesses 50 preferably have a width larger than the width of slit 7*a*. Further, both side surfaces of fastening member 10, facing radiator 4 in groove 9, are formed with screwed holes concentric with each other. Similarly, both side surfaces of fastening member 11., facing radiator 4 in groove 9, are formed with like screwed holes concentric with each other.

Fastening member 10 is retained within groove 9 by inserting bolt 12 through throughhole 31 from side surface 21, and inserting bolt 13 through throughhole 32 from side surface 22 and screwing bolt 13 into the screwed hole of fastening member 10. Similarly, fastening member 11 is retained within groove 9 by inserting bolt 14 through throughhole 33 from side surface 21, and inserting bolt 15 through throughhole 34 from side surface 22 and screwing bolt 15 into the screwed hole of fastening member 11. In this event, since the length of fastening members 10, 11 in a direction perpendicular to the direction of tube axis 70 is shorter than the length L of groove 9 as mentioned above, screwing length of bolts 12–15 may be adjusted to vary the gaps between radiator 4 and both ends of fastening members 10, 11 within groove 9, such that the degree of contact between radiator 4 and insulator 7 and collector electrode 6 can be adjusted by a fastening force transmitted from radiator 4 to entire insulator 7. Also, since head 12*h* of bolt 12 and head 14*h* of bolt 14 are embedded in recesses 41 and 43, respectively, bolt 12 and 14 will not protrude from side surface 21. Similarly, since head 13*h* of bolt 13 and the head 15*h* of bolt 15 are embedded in recess 42 and 44, respectively, bolt 13 and 15 will not protrude from side surface 22.

The positions of first straight line 71 and second straight line 72 perpendicular to the top surface, and the positions of the respective screwed holes of fastening members 10, 11 are determined in the following manner. Namely, the positions of first straight line 71 and second straight line 72 are preferably determined to be flush with the top surface of radiator 4 such that a straight line extending from the outer periphery of each throughhole 31–34, in parallel with first straight line 71 or second straight line 72, does not intersect insulator 7, and such that when fastening members 10, 11 are mounted in radiator 4 with their recesses 50 tube axis 70, the flat surfaces opposite to the surfaces formed with recesses 50 do not protrude from the top surface of radiator 4. When radiator 4 has sufficient heat radiation efficiency against the amount of heat generated by the collector core, the center lines of the screws (i.e., first straight line 71 and second straight line 72) can be lowered further toward heat sink 5 by increasing the depth of groove 9 from the top surface.

As described above in this embodiment, grooves 9 are formed at positions that do not contribute to the heat conduction from radiator 4 to heat sink 5 to expose insulator 7 and its slit 7*a*, thereby improving the heat radiation efficiency of heat generated by collector electrode 5 to heat sink 4. Also, since fastening members 10, 11 are dimensioned such that the top surface of radiator 4 is flush with the flat surfaces of fastening members 10, 11, a space for installing a waveguide or the like can be ensured above radiator 4 without increasing the volume of collector 3, resulting in a reduction in the size of the traveling-wave tube.

Figure 5A:
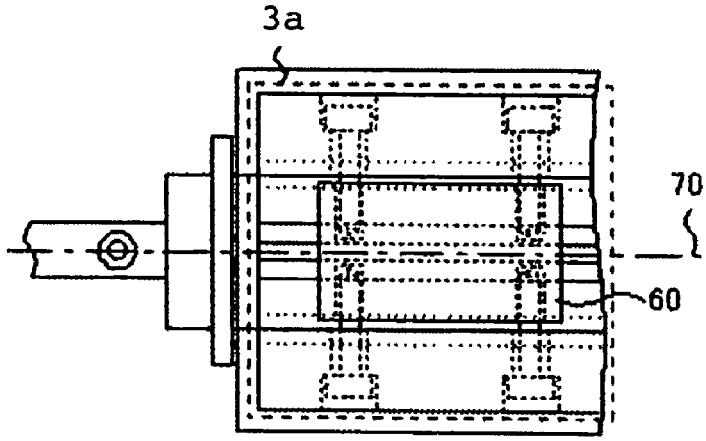
FIGS. 5 and 6 are views each illustrating a collector including a radiator of a traveling-wave tube according to another embodiment of the present invention, showing an example of an integrally formed fastening member.
Figure 5B:
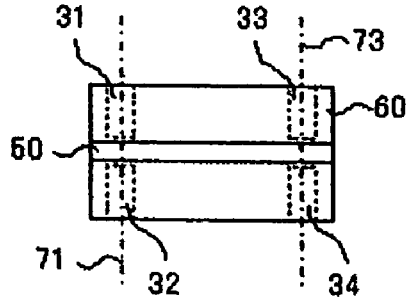
Figure 6A:
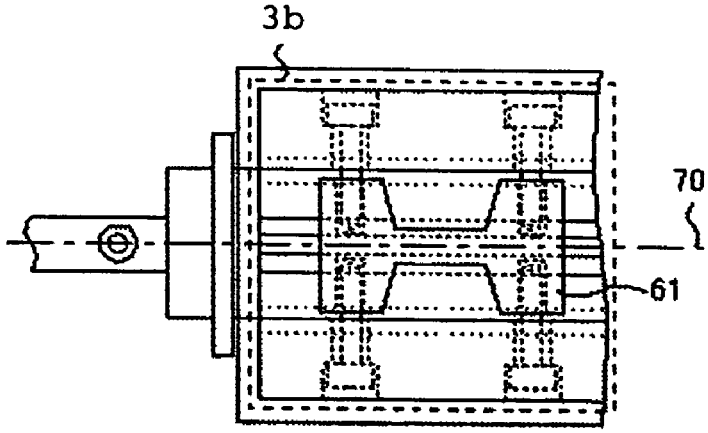
Figure 6B:
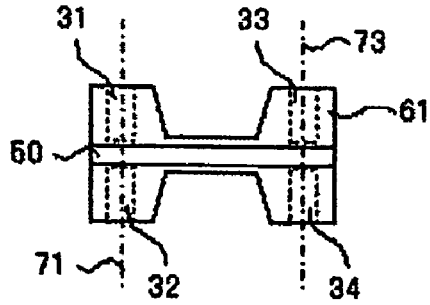

While the foregoing embodiment has been described in connection with an exemplary traveling-wave tube which has a plurality of fastening members, these fastening members may be formed in one piece as illustrated in FIGS. 5 and 6. FIG. 5A is a plan view (corresponding to FIG. 4A) of collector 3*a*, taken from the top surface thereof, which has fastening member 60 made in one piece and mounted in groove 9 of radiator 4, and FIG. 5B is a top plan view of fastening member 60 taken from tube axis 70. FIG. 6A is a top plan view (corresponding to FIG. 4A) of collector 3*b*, taken from the top surface thereof, which has a one-piece fastening member 61 mounted in groove 9 of radiator 4, and FIG. 6B is a top plan view of fastening member 61 taken from tube axis 70. When single fastening member 10, for example, is retained within groove 9 with a set of opposing bolts 12, 13 as in the exemplary embodiment described above, fastening member 10 is prone to rotate about a virtual axis connecting bolt 12 to bolt 13 when bolts 12, 13 are screwed into the screwed holes of fastening member 10, so that adjustments are required to maintain a consistent posture of mounted fastening member 10. On the other hand, a one-piece fastening member such as fastening member 60 or 61, once mounted, is definitely mounted in a consistent posture without requiring special adjustments or the like, thus facilitating the operation of mounting the fastening member.

The number of throughholes formed through the radiator, the positions of these throughholes in the direction along the tube axis, the shape of the fastening members, the number of screw holes in the fastening members, the positions of these screw holes in the direction along the tube axis, and the like may be set as appropriate in accordance with the size of the collector, and the size, weight and the like allowed for the traveling-wave tube.

While preferred embodiments of the present invention have been described using specific terms, such description is for illustrative purposes only, and it is to be understood that changes and variations may be made without departing from the spirit or the scope of the following claims.

What is claimed is:

1. A traveling-wave tube comprising:

an electronic gun unit for generating an electron beam;

a high-frequency circuit for amplifying high-frequency power through the interaction of an electron beam with a high-frequency electric field; and a collector unit for collecting an electron beam, said collector unit including:

a collector electrode for collecting the electron beam;

an insulator disposed around and in contact with the outer peripheral surface of said collector electrode, said insulator having a slit extending generally in parallel with a tube axis;

a radiator made in one piece and disposed outside of and in contact with said insulator, said radiator having a contact surface in contact with a predetermined mounting member, a slot formed on a surface of said radiator opposite to the contact surface and extending generally in parallel with the tube axis throughout the length of said radiator, and one or more grooves intersecting the slot at right angles, a portion of said insulator including said slit being exposed to the slot;

a fastening member received in said groove, said fastening member having a length shorter than the length of the groove, and formed with screwed holes extending through both end portions thereof in an axial direction of said fastening member; and bolts each screwed into each said screwed hole of said fastening member through a throughhole formed through said radiator.

2. The traveling-wave tube according to claim 1, wherein said radiator has a generally rectangular shape in a cross section perpendicular to said tube axis, and said fastening member has its height and mounting position in the groove set in such a manner that said fastening member does not protrude from the surface of said radiator.

3. The traveling-wave tube according to claim 1, wherein said fastening member is made of a material different from that of said radiator.

4. The traveling-wave tube according to claim 2, wherein said fastening member is made of a material different from that of said radiator.

5. The traveling-wave tube according to claim 3, wherein the mechanical strength of said fastening member is higher than that of said radiator.

6. The traveling-wave tube according to claim 4, wherein the mechanical strength of said fastening member is higher than that of said radiator.

* * * * *